US010906733B2

(12) United States Patent
Poyner et al.

(10) Patent No.: US 10,906,733 B2
(45) Date of Patent: Feb. 2, 2021

(54) SAFETY LATCH FOR A MUD SKIP

(71) Applicants: HFG Corporate Limited, Aberdeen (GB); GIRARD EQUIPMENT, INC., Vero Beach, FL (US)

(72) Inventors: Julian Poyner, Bramhall Stockport (GB); Kevin Sephton, Widnes (GB); Jarema Krywonos, Manchester (GB); Glen Harm, Port St. Lucie, FL (US)

( * ) Notice: Subject to any disclaimer, the term of this patent is extended or adjusted under 35 U.S.C. 154(b) by 261 days.

(21) Appl. No.: 16/188,857

(22) Filed: Nov. 13, 2018

(65) Prior Publication Data

US 2019/0144200 A1 May 16, 2019

Related U.S. Application Data

(60) Provisional application No. 62/585,017, filed on Nov. 13, 2017.

(51) Int. Cl.

| | |
|---|---|
| ***B65D 88/12*** | (2006.01) |
| ***E05C 17/00*** | (2006.01) |
| ***E05C 17/50*** | (2006.01) |
| ***B65D 90/10*** | (2006.01) |
| ***B65D 90/54*** | (2006.01) |
| ***E21B 21/01*** | (2006.01) |
| *E21B 21/06* | (2006.01) |

(52) U.S. Cl.

CPC ..... *B65D 88/126* (2013.01); *B65D 90/10* (2013.01); *B65D 90/54* (2013.01); *E05C 17/025* (2013.01); *E05C 17/50* (2013.01); *E21B 21/01* (2013.01); *E21B 21/066* (2013.01)

(58) Field of Classification Search

CPC combination set(s) only.
See application file for complete search history.

(56) References Cited

U.S. PATENT DOCUMENTS

| | | | |
|---|---|---|---|
| 2,594,533 | A | 4/1952 | Baker |
| 3,124,829 | A | 3/1964 | De Vito |
| 3,469,277 | A | 9/1969 | Henrichs et al. |
| 3,746,381 | A | 7/1973 | Colombo et al. |
| 3,843,177 | A | 10/1974 | Waldo |

(Continued)

FOREIGN PATENT DOCUMENTS

| | | |
|---|---|---|
| GB | 1410827 | 10/1975 |

OTHER PUBLICATIONS

SUG-SMH-40-CR Sugatsune Solid Brass Tabletop Hinge, 2 pages https://www.thehardwarehut.com/catalog-product.php?p_ref=194270.

*Primary Examiner* — Monica E Millner
(74) *Attorney, Agent, or Firm* — Wolter Van Dyke Davis, PLLC; Robert L. Wolter

(57) ABSTRACT

A safety latch for a mud skip container includes a first latch that is pivotal within a bracket that is mounted to a top of the container. The first latch may include a pivoting head with a downwardly projecting catch and an arm connected to the head. The arm extends through an aperture in the bracket and a spring is disposed about the arm between the head and an end wall of the bracket. The safety latch further includes a second latch mounted to a pivoting lid of the container; and, the second latch includes an upwardly projecting catch on a head of the latch. The head of the second latch is positioned over a pivot axis of the lid and positioned relative to the first latch such that the catches of respective first and second latches engage one another when the lid is opened.

18 Claims, 6 Drawing Sheets

(56) References Cited

U.S. PATENT DOCUMENTS 4,064,652 A 12/1977 Johnston
4,216,983 A 8/1980 Hough et al.
4,424,606 A * 1/1984 Sorimachi ..... E05F 1/1261 16/223
4,523,785 A 6/1985 Draper et al.
4,572,572 A 2/1986 Nakamura et al.
4,609,216 A 9/1986 Baker et al.
4,893,850 A 1/1990 Mizusawa
5,346,267 A 9/1994 Betteridge et al.
5,542,734 A 8/1996 Burchett et al.
5,570,981 A 11/1996 Brewster
5,937,481 A * 8/1999 Faringosi ..... F24C 15/023 16/332
6,032,815 A 3/2000 Elstone
6,038,738 A 3/2000 Neag et al.
6,564,511 B2 5/2003 Toth
7,003,849 B2 2/2006 Cohen et al.
7,203,996 B2 4/2007 Linnenbrink et al.
7,373,693 B2 * 5/2008 Markl ..... E05D 11/0054 16/334
7,418,766 B2 9/2008 Nelson et al.
7,610,656 B2 * 11/2009 Vanini ..... E05F 1/1261 16/286
7,949,292 B2 * 5/2011 Choi ..... E05D 3/02 399/380
8,448,385 B2 5/2013 Brewster et al.
8,695,825 B2 4/2014 Oksnevad
8,813,311 B2 * 8/2014 Li ..... E05D 11/1064 16/286
9,248,555 B2 2/2016 Ford, Jr.
2004/0117948 A1 * 6/2004 Ohara ..... B41J 29/13 16/286
2007/0199178 A1 * 8/2007 Katsumata ..... E05F 1/1261 16/286
2007/0240282 A1 10/2007 Nishida
2014/0026362 A1 1/2014 Li
2016/0047147 A1 2/2016 James
2017/0058586 A1 3/2017 Lee
2017/0059176 A1 * 3/2017 SirLouis ..... E05D 3/02

* cited by examiner

SAFETY LATCH FOR A MUD SKIP

FIELD OF THE INVENTION

Aspects of the invention relate generally to safety latches to hold open container lids. More specifically, embodiments of the invention relate to safety latches for mud skips.

BACKGROUND OF THE INVENTION

Mud skips are large containers used for the transport and disposal of drill cuttings or shavings in the offshore oil and gas industry. Some mud skips have a volume of over 280 cubic feet. Accordingly, the lids of mud skips are large and heavy and can pose a safety hazard when left open during filling or emptying the container.

It is an object of aspects of the invention to provide a safety latch that minimizes safety hazards that may exist during use of mud skips and, in particular, safety hazards relating to lids of mud skips.

SUMMARY OF THE INVENTION

According to a first aspect of the invention there is provided a safety latch for a mud skip, comprising a mounting bracket including a first side wall spaced apart from and parallel to a second side wall and an end wall perpendicular to the first and second side walls and contiguous with respective first ends of the first and second side walls, an opening between second ends of the first and second side walls, an aperture in the end wall, a first boss on an interior surface of the first side wall and a second boss on an interior surface of the second side wall, and the first and second bosses are concentrically aligned with each other, a first latch including a head pivotally connected to the first and second bosses, a downwardly projecting catch on the head facing the opening, an arm affixed to the head and extending through the aperture of the end wall, a spring about the arm of the first latch and having a first end against the head of the first latch, and a second end against the end wall, a second latch pivotal toward and away from the first latch, and the second latch has a head with an upwardly projecting catch that when pivoted toward the first latch the head of the second latch pivots against the head of the first latch pushing the first latch toward the end wall until the catch of the second latch passes the catch of the first latch and the spring then biases the first latch toward opening and the respective catches engage.

The mounting bracket may further comprise a plate member extending from the first side wall to the second side wall below the head of the first latch.

The mounting bracket may further comprise a first mounting flange at the second end of the first side wall and a second mounting flange at the second end of the second side wall.

The head of the first latch may include a first socket on a first side of the head and within which the first boss is disposed and a second socket on a second side of the head and within which the second boss is disposed.

A first U-shaped boss may be on the first side of the head of the first latch defining the first socket, and a second U-shaped boss may be on the second side of the head of the first latch defining the second socket.

The safety latch may further comprise a spring washer disposed on the arm between the second end of the spring and the end wall.

According to a second aspect of the invention there is provided a safety latch for a mud skip, comprising a mounting bracket including a first side wall spaced apart from and parallel to a second side wall and an end wall perpendicular to the first and second side walls and contiguous with respective first ends of the first and second side walls, an opening between second ends of the first and second side walls, and an aperture in the end wall, a first latch including a head pivotally connected to the first and second side walls, a downwardly projecting catch on the head facing the opening, an arm affixed to the head and extending through the aperture of the end wall, a biasing mechanism operatively connected to the head of the first latch and the end wall that biases the head of the first latch toward the opening of the bracket, a second latch pivotal toward and away from the first latch, and the second latch has a head with an upwardly projecting catch that when pivoted toward the first latch the head of the second latch pivots against the head of the first latch pushing the first latch toward the end wall until the catch of the second latch passes the catch of the first latch and the biasing mechanism then biases the first latch toward opening and the respective catches engage.

The biasing mechanism may be a compression spring disposed about the arm of the first latch.

The safety latch may further comprise a first boss on an interior surface of the first side wall and a second boss on an interior surface of the second side wall. The first and second bosses may be concentrically aligned with each other. The head of the first latch may be pivotally connected to first and second bosses.

The head of the first latch may include a first socket on a first side of the head and within which the first boss is disposed and a second socket on a second side of the head and within which the second boss is disposed.

A first U-shaped boss may be on the first side of the head of the first latch defining the first socket and a second U-shaped boss may be on the second side of the head of the first latch defining the second socket.

According to a third aspect of the invention there is provided a mud skip, comprising a container with four side walls mounted to a bottom wall and a top wall and an opening in the top wall, a lid pivotally attached to the top wall and covering the opening when in a closed position and the lid having a pivot axis, a mounting bracket mounted to the top wall of the container adjacent to the pivot axis and including a first side wall spaced apart from and parallel to a second side wall and an end wall perpendicular to the first and second side walls and contiguous with respective first ends of the first and second side walls, an opening between second ends of the first and second side walls facing the pivot axis, an aperture in the end wall, a first boss on an interior surface of the first side wall and a second boss on an interior surface of the second side wall, and the first and second bosses are concentrically aligned with each other, a first latch including a head pivotally connected to the first and second bosses, a downwardly projecting catch on the head facing the opening, an arm affixed to the head and extending through the aperture of the end wall, a spring about the arm and having a first end against the head, and a second end against the end wall, a second latch mounted to the lid and having a head with an upwardly projection catch and the head is pivotal about the pivot axis when the lid is pivoted between an open position and the closed position, and in the open position the respective catches of the first and second latch engage.

The lid may be pivotal to a locked open position. The head of the second latch may pivot against the head of the first latch, biasing the first latch toward the end wall until the catch of the second latch passes the catch of the first latch. The spring may bias the first latch toward the second latch. The respective catches may then engage.

The mounting bracket may further comprise a plate member extending from the first side wall to the second side wall below the head of the first latch.

The mounting bracket may further comprise a first mounting flange at the second end of the first side wall and a second mounting flange at the second end of the second side wall.

The head of the first latch may include a first socket on a first side of the head and within which the first round boss is disposed and a second socket on a second side of the head and within which the second round boss is disposed.

A first U-shaped boss may be on the first side of the head of the first latch defining the first socket and a second U-shaped boss may be on the second side of the head of the first latch defining the second socket.

The second latch may include an extension integrally connected with the head and the extension is mounted to the lid with the head of the second disposed over a pivot axis of the lid.

In accordance with various aspects of the invention, a safety latch for a mud skip comprises a mounting bracket including a first side wall spaced apart from and parallel to a second side wall. An end wall is perpendicular to the first and second side walls and contiguous with respective first ends of the first and second side walls. The bracket further includes an opening between the second ends of the first and second side walls, an aperture is in the end wall, and a first boss is on an interior surface of the first side wall and a second boss is on an interior surface of the second side wall, and the first and second bosses are concentrically aligned with each other.

The safety latch further includes a first latch having a head pivotally connected to the first and second bosses, and a downwardly projecting catch is on the head facing the opening. In addition, an arm is affixed to the head and extends through the aperture of the end wall. A spring is disposed about the arm of the first latch, and the spring has a first end against the head of the first latch, and a second end against the end wall. In addition, a second latch is pivotal toward and away from the first latch, and the second latch has a head with an upwardly projecting catch. When pivoted toward the first latch, the head of the second latch pivots against the head of the first latch pushing the first latch toward the end wall until the catch of the second latch passes the catch of the first latch. The spring then biases the first latch toward the opening and the respective first and second catches engage, thereby locking the first and second latches together and locking the lid of the mud skip in an open position.

BRIEF DESCRIPTION OF THE DRAWINGS

The features and advantages of the present invention will become apparent from the following detailed description of the invention when read with the accompanying drawings.

DETAILED DESCRIPTION OF THE INVENTION

Figure 1:
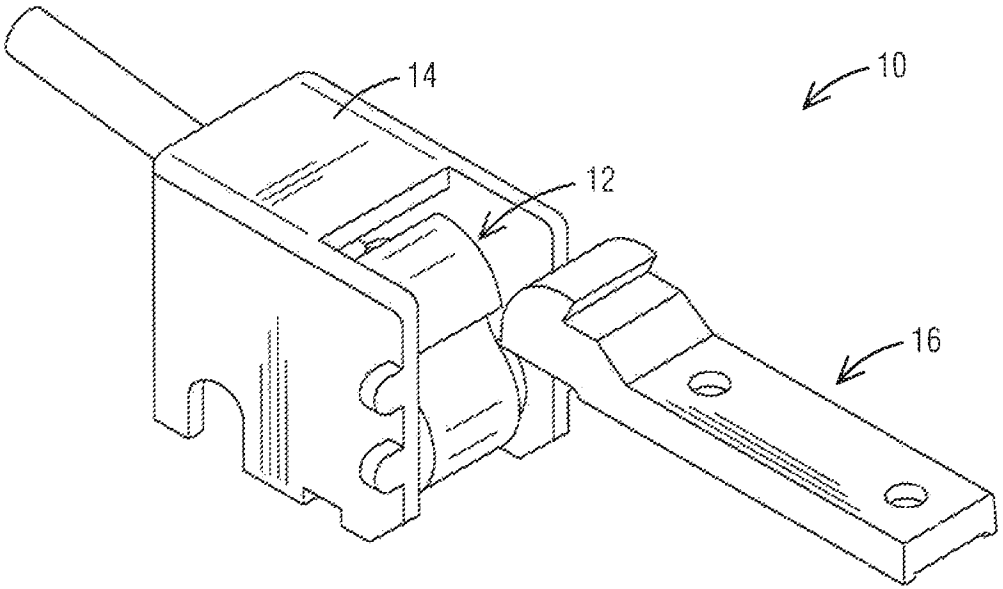
FIG. 1 is a first perspective view of a safety latch for a mud skip in accordance with aspects of the invention.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

In reference to FIGS. 1-4 a safety latch 10 is shown including various components and parts. More specifically, embodiments of the safety latch 10 may comprise a first latch 12 spring loaded in a mounting bracket 14 that is mounted or affixed to a top 13 of a mud skip 11. A second latch 16 is mounted onto a lid 15 of the mud skip 11 and positioned adjacent to the first latch 12. As will be explained in more detail below, when the lid is pivoted to an open position the first and second latches 12, 16 engage one another, thereby locking the lid in the open position.

Figure 5A:
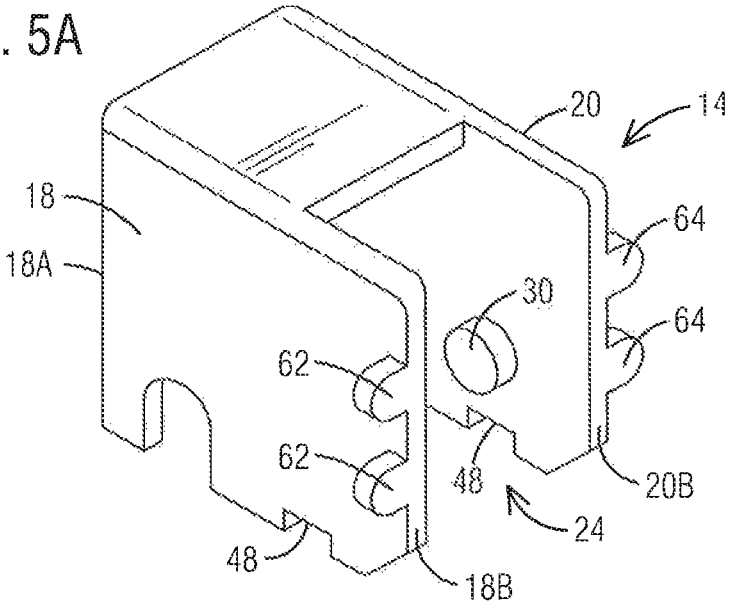
FIG. 5A is a perspective view of the bracket of the safety latch.
Figure 5B:
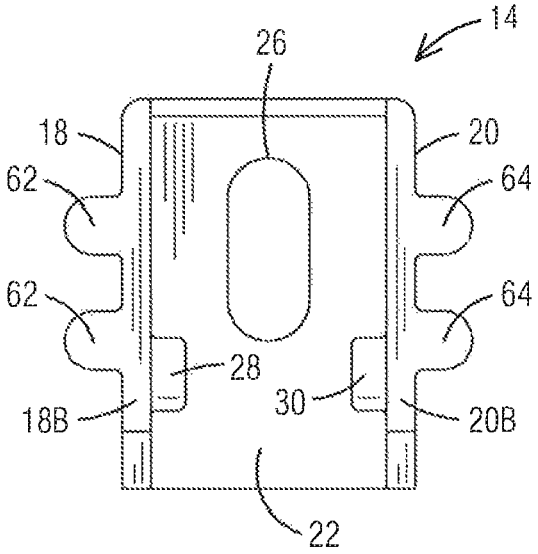
FIG. 5B is a front view of the bracket.
Figure 5C:
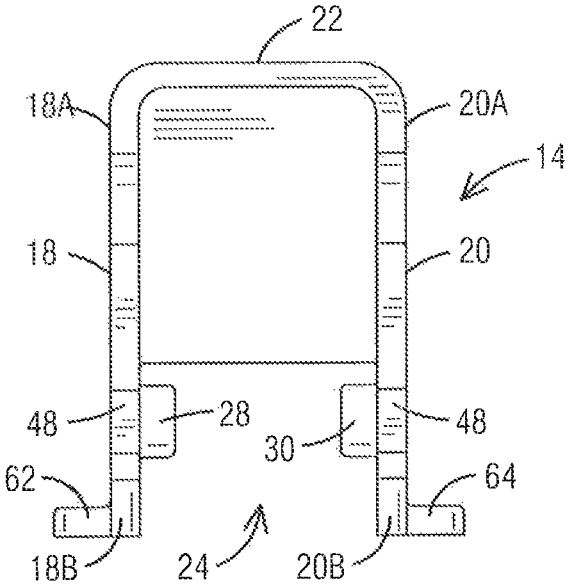
FIG. 5C is a bottom view of the first bracket.

The mounting bracket 14 is shown in more detail in the drawings of FIGS. 5A, 5B and 5C. As shown, the mounting bracket 14 includes a first side wall 18 that is spaced apart from and parallel to a second side wall 20. An end wall 22 is contiguous with first ends 18A, 20A of the first and second side walls 18, 20. An opening 24 is disposed at the second ends 18B, 20B of the side walls 18, 20 and opposite the end wall 22. The first and second latches 12, 16 engage one another at the opening 24. The end wall 22 includes an elongated aperture 26 through which an arm or handle of the first latch 12 extends to control movement of the first latch 12 as may be needed to disengage the first and second latches 12, 16.

The mounting bracket 14 may further include a first boss 28 on an interior surface of the first side wall 18 and a second boss 30 on an interior surface of the second side wall 20. In the embodiment shown in the drawings of FIGS. 5A, 5B and 5C, the first and second bosses 28, 30 have a round geometric configuration and are concentrically aligned with each other. However, the invention is not so limited and may include bosses with different geometric configurations, such as a semi-circular shape or other shapes such that the interface between the bosses and first latch 12 allow the first latch 12 to pivot within the bracket 14.

As further shown, the bracket 14 may include one or more first mounting flanges 62 at the second end 18B of the first side wall 18 and one or more second mounting flanges 64 at the second end 20B of the second side wall 20.

Figure 6A:
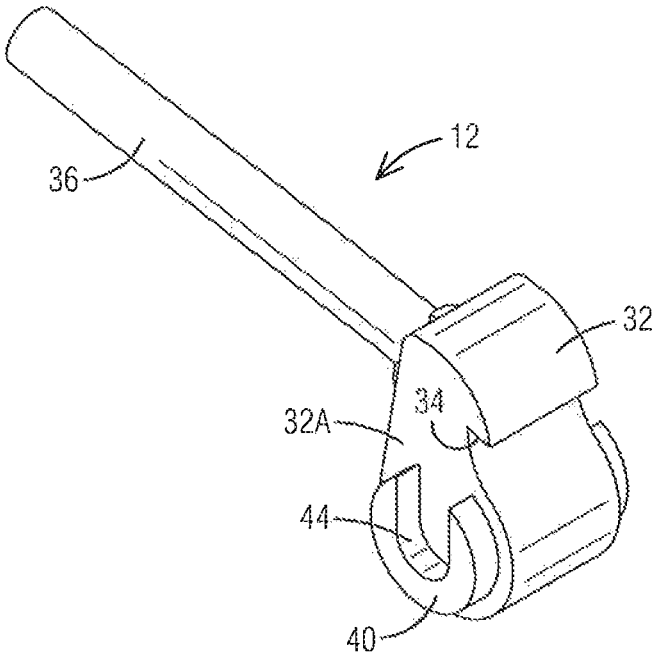
FIG. 6A is a perspective view of a first latch of the safety latch
Figure 6B:
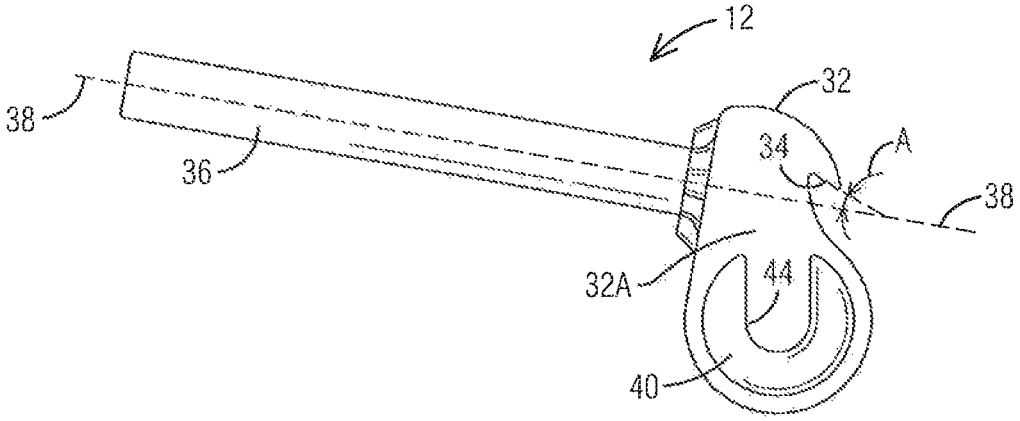
FIG. 6B is a side view of the first latch.
Figure 6C:
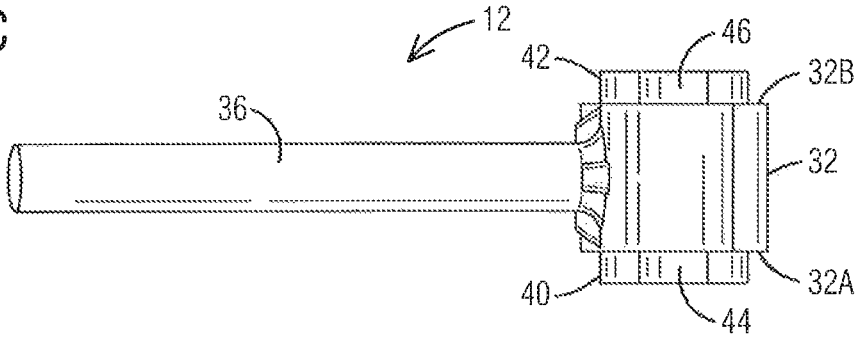
FIG. 6C is a top view of the first latch.

With respect to FIGS. 6A, 6B and 6C, the first latch 12 is shown in more detail. As shown, the first latch 12 includes a head 32 that includes a downwardly projecting catch 34. The first latch 12 further includes an arm 36 connected to the head 32 and as shown in FIG. 1, when the head 32 is disposed within the mounting bracket 14, the arm 36 extends toward the end wall 22 and through the elongated aperture 26. In a preferred embodiment, the catch 34 has a downwardly facing surface that is disposed at an upward angle A of about 5° relative to a longitudinal axis 38 of the arm 34.

Figure 2:
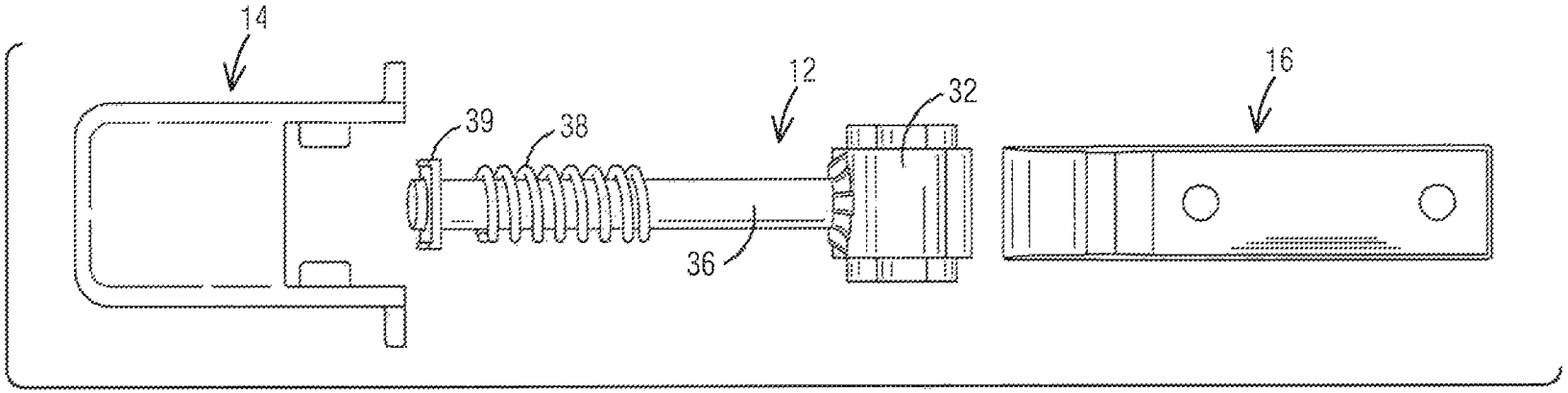
FIG. 2 is a top exploded view of the safety latch.
Figure 3:
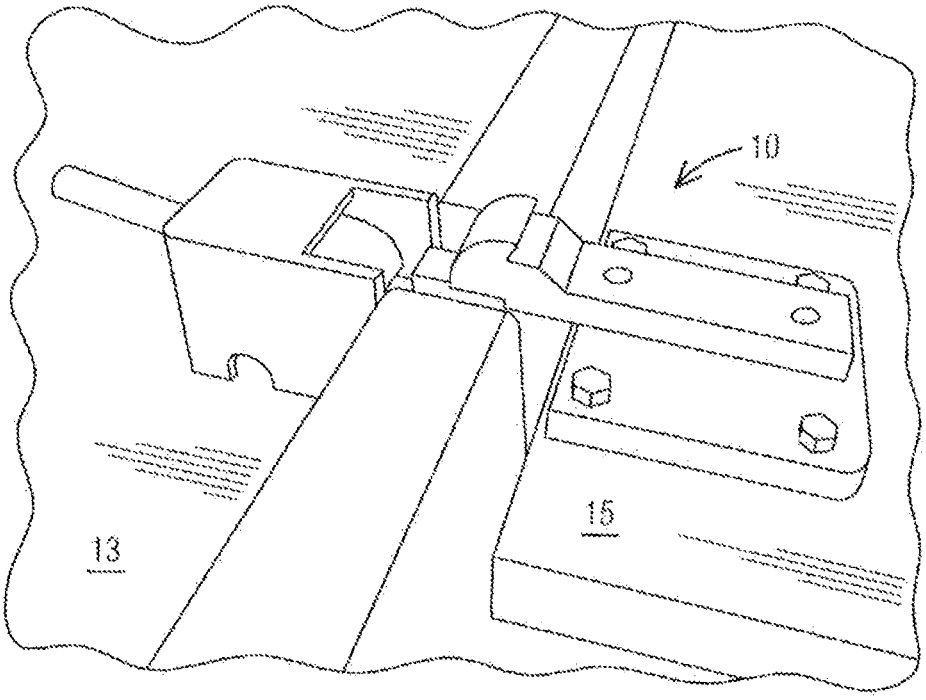
FIG. 3 is a perspective of the safety latch on a mud skip with the mud skip lid in a closed.
Figure 4:
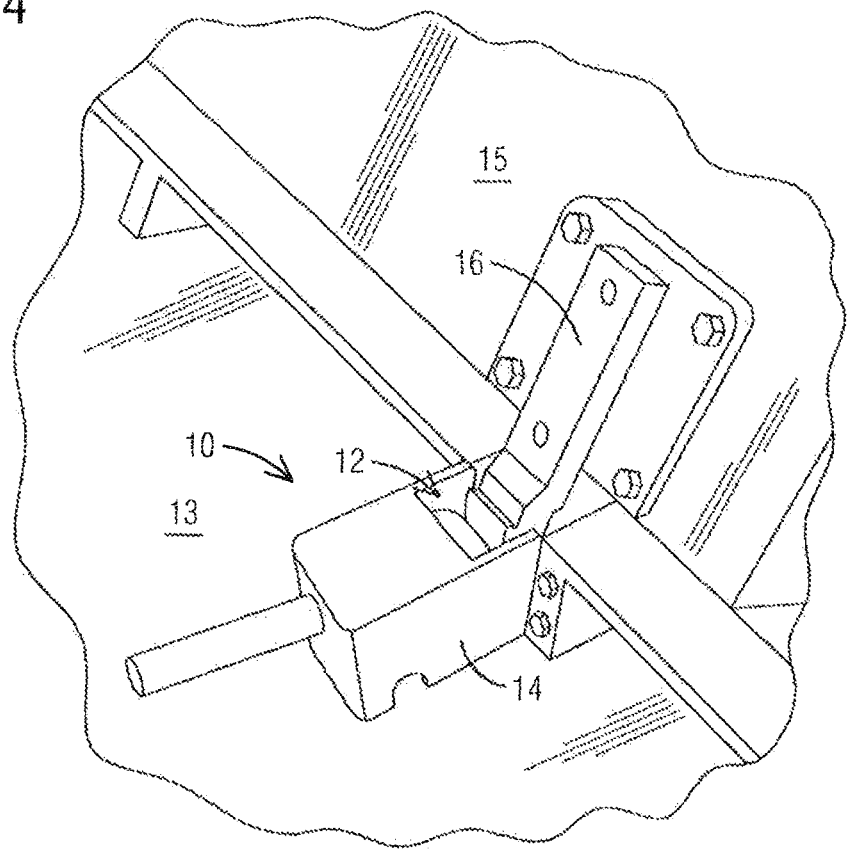
FIG. 4 is a perspective view of the safety latch of FIG. 3 with the lid being opened.

A compression spring 38, as the one shown in FIG. 2, is disposed about the arm and biased against the end wall 22 and the head 32 of the first latch 12. In an embodiment, a radial spring washer 39, as the one shown in FIG. 5, is disposed between an end of the spring 38 and the end wall 22.

As further shown in FIGS. 6A, 6B and 6C, a first generally U-shaped boss 40 is disposed on a first side 32A of the head 32 of the first latch 12, and a second generally U-shaped boss 42 is disposed on a second side 32B of the head 32. The first and second bosses 40, 42 define first and second sockets 44, 46 in which bosses 28, 30 (FIG. 2) are received to the head 32 of the first latch 12 so that the first latch is pivotal about the round bosses 28, 30.

The first latch 12 is placed in the mounting bracket 14 with the arm 36 extending through the elongated aperture 26 and the sockets 44, 46 are aligned with the round bosses 28, 30 to seat the bosses 28, 30 in the corresponding sockets 44, 46. In this manner, the first latch 12 is pivotal relative to the bracket 14; however, the invention is not limited to this particular pivoting configuration and other arrangements could be implemented so the first latch 12 is pivotal relative to the bracket 14.

Figure 8:
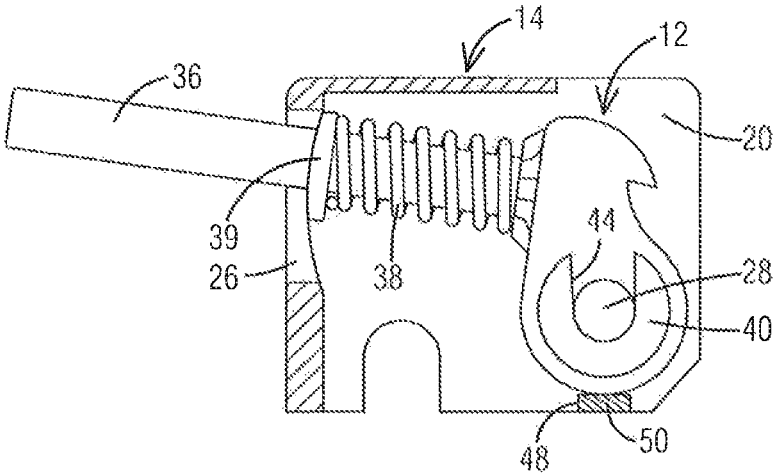
FIG. 8 is sectional view of the bracket with the first latch.

Again in reference to FIGS. 5A, 5B and 5C, the first and second side walls 18, 20 each have a recess 48 that is aligned with a respective round boss 28, 30. Once the first latch 12 is positioned with the mounting bracket 14, a support plate 50 (as shown in FIG. 8) is welded into the recesses 48 to support the first latch 12 in the mounting bracket 14.

Figure 7A:
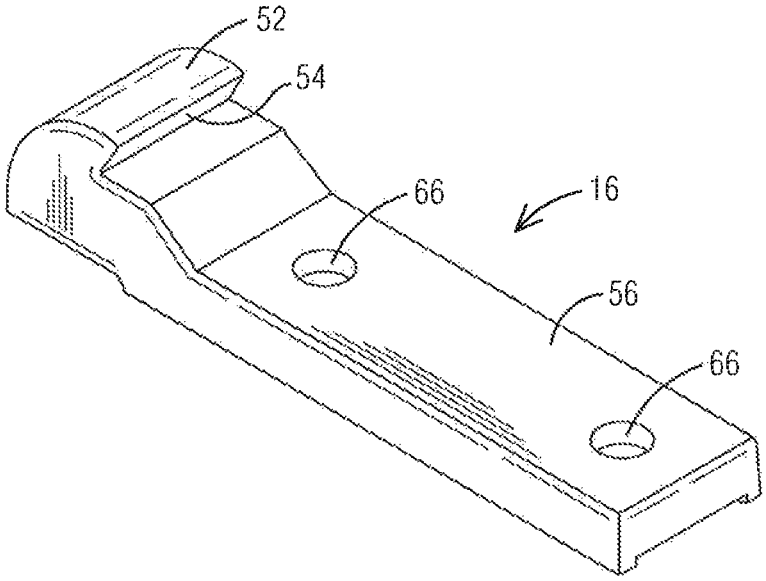
FIG. 7A is perspective view of a second latch of the safety latch.
Figure 7B:
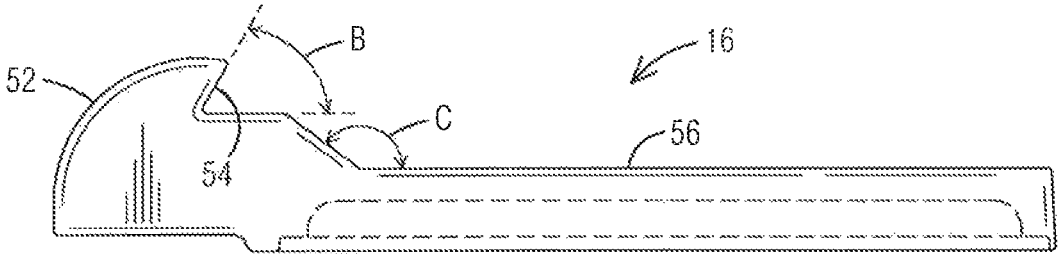
FIG. 7B is a side view of the second latch.

With respect to FIGS. 7A and 7B, a second latch 16 is shown including a head 52 and an upwardly projecting catch 54 on the head 52. An extension 56 is integrally formed with the head 52 and the extension 56 is mounted to an outer surface of a lid 15 of a mud skip container, wherein the head 52 is disposed over a pivot axis 58 (FIG. 9A) of the lid 15. The extension 56 is preferably mounted in such a manner that the head 52 clears any lid 15 or hinge components during opening or closing of the lid 15.

The head 52 of the second latch 16 includes a catch 54 that has an upwardly projecting surface that is disposed at an angle B (FIG. 7B) that is 60° relative to a horizontal surface of the catch 54. In addition, an inclined surface 64 between the head 54 and extension 56 is disposed at an angle C of about 36° relative to horizontal. Bolt holes 66 are provided for mounting the second latch 16 to a lid of a mud skip. Alternatively, or in addition, the extension 56 can be welded to the lid using known welding techniques.

Figure 9A:
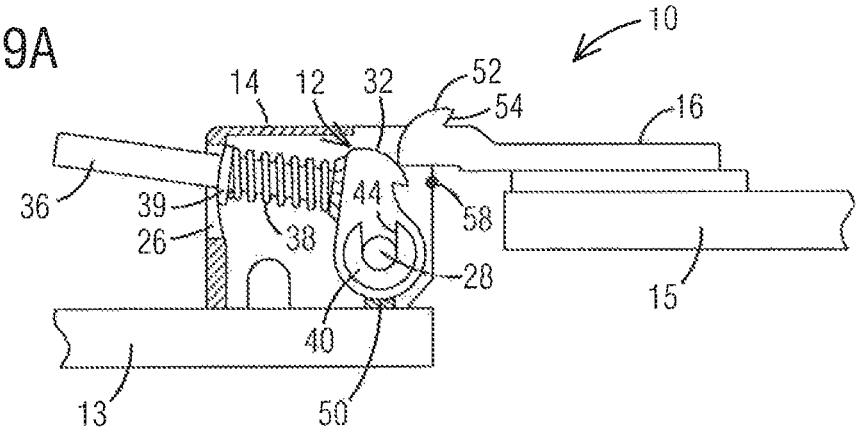
FIG. 9A is a side view of the safety latch mounted on a mud skip, with the lid of the mud skip in a closed position.
Figure 9B:
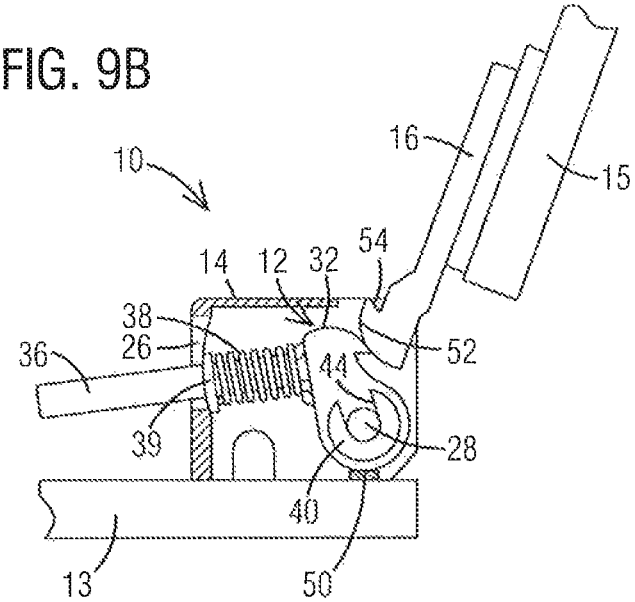
FIG. 9B is a side view of the safety latch of FIG. 9A with the lid pivoted to an open position.
Figure 9C:
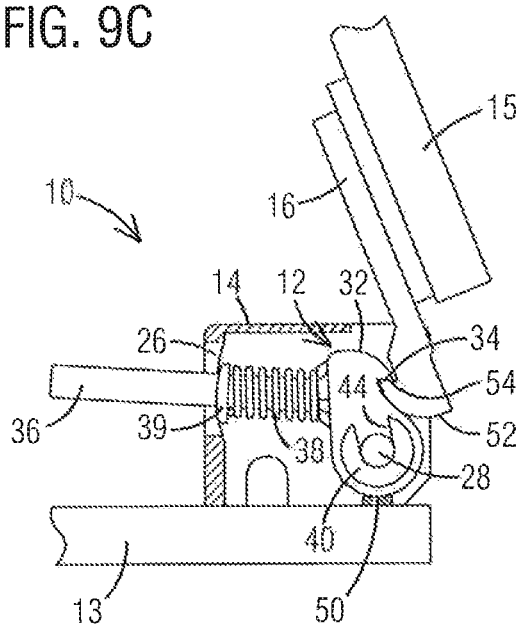
FIG. 9C is a side view of the safety latch of FIGS. 9A and 9B, with the safety latch in a locked position, and the lid of the mud skip is locked open.

As further shown in FIGS. 9A, 9B, and 9C, the bracket 14 is mounted on a top wall 13 of a container with the opening 24 facing the hinge, pivot axis 58 of the lid 15 and/or the second latch 16. Both the head 32 of the first latch 12 and the head 52 of the second latch 16 have an arcuate shape so that when the lid 62 is pivoted open the head 52 of the second latch 16 pivots against the head 32 of the first latch 12. With respect to FIG. 9B, when opening the lid 15, the head 52 of the second latch 16 pivots against the head 32 of the first latch 12, pushing the first latch 12 against the bias of the spring 38 and toward the end wall 22 of the bracket 14. Once the catch 54 of the second latch 16 passes the catch 34 of the first latch 12, the bias of the spring 38 moves the first latch 12 toward the second latch 16 and the respective catches 34, 54 engage one another locking the lid 15 in an open position.

In this manner, the lid 15 is safely locked in an open position and cannot close without manually actuating the first latch 12. More specifically, a downward force is applied to the arm 36 to causing the head 32 of the first latch 14 to pivot and disengage from the second latch 16. With the first latch 12 and second latch 16 disengaged, the lid 15 can be lowered to a closed position.

While various embodiments of the present invention have been shown and described herein, it will be obvious that such embodiments are provided by way of example only. Embodiments of the invention may have catches which subtend angles that differ from the angles mentioned above. Similarly, the inclined surface of the second latch may subtend a different angle. Numerous variations, changes and substitutions may be made without departing from the invention herein. Accordingly, it is intended that the invention be limited only by the spirit and scope of the appended claims.

The invention claimed is:

1. A safety latch for a mud skip, comprising:

a mounting bracket including a first side wall spaced apart from and parallel to a second side wall and an end wall perpendicular to the first and second side walls and contiguous with respective first ends of the first and second side walls, an opening between second ends of the first and second side walls, an aperture in the end wall, a first boss on an interior surface of the first side wall and a second boss on an interior surface of the second side wall, and the first and second bosses are concentrically aligned with each other;

a first latch including a head pivotally connected to the first and second bosses, a downwardly projecting catch on the head facing the opening, an arm affixed to the head and extending through the aperture of the end wall;

a spring about the arm of the first latch and having a first end against the head of the first latch, and a second end against the end wall;

a second latch pivotal toward and away from the first latch, and the second latch has a head with an upwardly projecting catch that when pivoted toward the first latch the head of the second latch pivots against the head of the first latch pushing the first latch toward the end wall until the catch of the second latch passes the catch of the first latch and the spring then biases the first latch toward opening and the respective catches engage.

2. The safety latch of claim 1, wherein the mounting bracket further comprises a plate member extending from the first side wall to the second side wall below the head of the first latch.

3. The safety latch of claim 1, wherein the mounting bracket further comprises a first mounting flange at the second end of the first side wall and a second mounting flange at the second end of the second side wall.

4. The safety latch of claim 1, wherein the head of the first latch includes a first socket on a first side of the head and within which the first boss is disposed and a second socket on a second side of the head and within which the second boss is disposed.

5. The safety latch of claim 4, wherein a first U-shaped boss is on the first side of the head of the first latch defining the first socket and a second U-shaped boss is on the second side of the head of the first latch defining the second socket.

6. The safety latch of claim 1, further comprising a spring washer disposed on the arm between the second end of the spring and the end wall.

7. A safety latch for a mud skip, comprising:

a mounting bracket including a first side wall spaced apart from and parallel to a second side wall and an end wall perpendicular to the first and second side walls and contiguous with respective first ends of the first and second side walls, an opening between second ends of the first and second side walls, and an aperture in the end wall;

a first latch including a head pivotally connected to the first and second side walls, a downwardly projecting catch on the head facing the opening, an arm affixed to the head and extending through the aperture of the end wall;

a biasing mechanism operatively connected to the head of the first latch and the end wall that biases the head of the first latch toward the opening of the bracket;

a second latch pivotal toward and away from the first latch, and the second latch has a head with an upwardly projecting catch that when pivoted toward the first latch the head of the second latch pivots against the head of the first latch pushing the first latch toward the end wall until the catch of the second latch passes the catch of the first latch and the biasing mechanism then biases the first latch toward opening and the respective catches engage.

8. The safety latch of claim 7, wherein the biasing mechanism is a compression spring disposed about the arm of the first latch.

9. The safety latch of claim 7, further comprising a first boss on an interior surface of the first side wall and a second boss on an interior surface of the second side wall, and the first and second bosses are concentrically aligned with each other, and the head of the first latch is pivotally connected to first and second bosses.

10. The safety latch of claim 9, wherein the head of the first latch includes a first socket on a first side of the head and within which the first boss is disposed and a second socket on a second side of the head and within which the second boss is disposed.

11. The safety latch of claim 10, wherein a first U-shaped boss is on the first side of the head of the first latch defining the first socket and a second U-shaped boss is on the second side of the head of the first latch defining the second socket.

12. A mud skip, comprising:

a container with four side walls mounted to a bottom wall and a top wall and an opening in the top wall;

a lid pivotally attached to the top wall and covering the opening when in a closed position and the lid having a pivot axis;

a mounting bracket mounted to the top wall of the container adjacent to the pivot axis and including a first side wall spaced apart from and parallel to a second side wall and an end wall perpendicular to the first and second side walls and contiguous with respective first ends of the first and second side walls, an opening between second ends of the first and second side walls facing the pivot axis, an aperture in the end wall, a first boss on an interior surface of the first side wall and a second boss on an interior surface of the second side wall, and the first and second bosses are concentrically aligned with each other;

a first latch including a head pivotally connected to the first and second bosses, a downwardly projecting catch on the head facing the opening, an arm affixed to the head and extending through the aperture of the end wall;

a spring about the arm and having a first end against the head, and a second end against the end wall;

a second latch mounted to the lid and having a head with an upwardly projecting catch and the head is pivotal about the pivot axis when the lid is pivoted between an open position and the closed position, and in the open position the respective catches of the first and second latch engage.

13. The mud skip of claim 12, wherein when the lid is pivotal to a locked open position, the head of the second latch pivots against the head of the first latch, biasing the first latch toward the end wall until the catch of the second latch passes the catch of the first latch and then the spring biases the first latch toward the second latch and the respective catches engage.

14. The safety latch of claim 12, wherein the mounting bracket further comprises a plate member extending from the first side wall to the second side wall below the head of the first latch.

15. The safety latch of claim 12, wherein the mounting bracket further comprises a first mounting flange at the second end of the first side wall and a second mounting flange at the second end of the second side wall.

16. The safety latch of claim 12, wherein the head of the first latch includes a first socket on a first side of the head and within which the first round boss is disposed and a second socket on a second side of the head and within which the second round boss is disposed.

17. The safety latch of claim 16, wherein a first U-shaped boss is on the first side of the head of the first latch defining the first socket and a second U-shaped boss is on the second side of the head of the first latch defining the second socket.

18. The safety latch of claim 12, wherein the second latch includes an extension integrally connected with the head and the extension is mounted to the lid with the head of the second disposed over a pivot axis of the lid.

* * * * *